US007014515B2

(12) United States Patent
Lutsch et al.

(10) Patent No.: US 7,014,515 B2
(45) Date of Patent: Mar. 21, 2006

(54) FEMALE TERMINAL FOR A FLAT MALE TERMINAL

(75) Inventors: Harald Michael Lutsch, Weiterstadt (DE); Ranko Resman, Zagreb (HR); Mario Lekic, Zagreb-Sesvete (HR); Goran Petrovic-Poljak, Zagreb (HR)

(73) Assignee: Yazaki Europw Ltd., Hertfordshire (GB)

( * ) Notice: Subject to any disclaimer, the term of this patent is extended or adjusted under 35 U.S.C. 154(b) by 0 days.

(21) Appl. No.: 10/898,255

(22) Filed: Jul. 26, 2004

(65) Prior Publication Data

US 2005/0054247 A1 Mar. 10, 2005

(30) Foreign Application Priority Data

Jul. 30, 2003 (DE) ..... 103 35 196

(51) Int. Cl.
*H01R 11/20* (2006.01)

(52) U.S. Cl. ..... 439/843; 439/852

(58) Field of Classification Search ..... 439/839, 439/852, 862, 843

See application file for complete search history.

(56) References Cited

U.S. PATENT DOCUMENTS 5,338,229 A * 8/1994 Egenolf ..... 439/839
5,685,746 A 11/1997 Maejima (Continued)

FOREIGN PATENT DOCUMENTS

DE 43 12641 A1 10/1994
DE 19602822 C2 2/1998
DE 297 19 153 U1 4/1999
DE 19944280 C1 2/2001

(Continued)

*Primary Examiner*—Briggitte R. Hammond
(74) *Attorney, Agent, or Firm*—Sughrue Mion, PLLC

(57) ABSTRACT

A female terminal for receiving a flat male terminal with a terminal tab (5), having a rectangular cross-section and a predetermined width (B) and thickness (D). The female terminal includes a contact element (1, 101) having two elastic contact tabs (3, 103) approaching each other along a longitudinal axis (2, 102), the contact tabs opposing contact zones (4, 104) for contacting the terminal tab (5); a hollow, rectangular support element (16, 116) defined by four walls (19, 20, 21, 22; 119, 120, 121, 122), enclosing the contact element (1, 101) and in which the elastic contact tabs (3, 103) are accommodated; and a device (13, 113) for electrically connecting a conductor. A first pair of opposing walls (19, 21; 119, 121) cover the contact tabs (3, 103) and a second pair of opposing walls (20, 22; 120, 122) have an elastic locking tab (26, 126) connected thereto. The elastic locking tabs (26, 126) engage between the elastic contact tabs (3, 103) and hold the contact zones (4, 104) of the contact tabs in a pre-tensioned and contact free manner at a distance (A) from each other, which is smaller than the thickness (D) of the terminal tab (5), in a condition in which the flat male terminal is not inserted. The locking tabs (26, 126) have a free distance (C) therebetween before the insertion of the terminal tab (5), which is smaller than the width (B) of the terminal tab (5) and the locking tabs (26, 126) contact the terminal tab (5) in the inserted position along the longitudinal axis (2, 102) in a contact area which is off-set further from the first end (17, 117) of the support element (16, 116) than the contact zones (4, 104) of the contact tabs (3, 103).

7 Claims, 5 Drawing Sheets

U.S. PATENT DOCUMENTS

| | | | | |
|---|---|---|---|---|
| 5,868,590 | A | 2/1999 | Dobbelaere | |
| 5,941,741 | A * | 8/1999 | Dobbelaere et al. | 439/852 |
| 6,126,495 | A | 10/2000 | Lolic et al. | |
| 6,402,571 | B1 | 6/2002 | Muller et al. | |

FOREIGN PATENT DOCUMENTS

| | | | |
|---|---|---|---|
| DE | 102 44 946 | A1 | 4/2003 |
| EP | 0 352 871 | B1 | 12/1985 |

* cited by examiner

FEMALE TERMINAL FOR A FLAT MALE TERMINAL

BACKGROUND OF THE INVENTION

The invention relates to a female terminal for a flat male terminal with a terminal tab, having a rectangular cross-section.

DE 297 19 153 U1 describes a female terminal for a flat male terminal with a terminal tab, having a rectangular cross-section with a predetermined width and thickness. The female terminal comprises a contact element, forming a longitudinal axis. The contact element has two elastic contact tabs, which approach each other along the longitudinal axis and have, respectively, a contact zone, serving to contact the terminal tab in a clamped manner between each other. The contact zones are arranged opposed to each other. The female terminal comprises further a support element, formed tubular and delimited by walls, enclosing the contact element. In the support element the elastic contact tabs are accommodated. The contact tabs are acted upon by support tabs. The support element has on two opposed walls, respectively, a locking tab, which engages between the elastic contact tabs and which hold the contact zones of these, as long as no flat male terminal is inserted, pre-tensioned at a distance to each other, which is smaller than the thickness of the to be inserted terminal tab. The locking tabs shall, further, guide the flat male terminal during insertion. They are bent to the inside towards the contact point area and are connected with their ends, arranged close to the insertion opening of the female terminal, to the mating walls.

EP 0 352 871 B1 describes a female terminal for a flat male terminal with a terminal tab, having a rectangular cross-section and named in the description as a box-like spring. The female terminal comprises a contact element, having a base portion, from which two elastic contact tabs extend and which extend away from the first end along the longitudinal axis and approach each other. The contact tabs form at their free ends contact zones. The contact tabs extend, starting from the contact zones, away from each other. The contact element and especially the elastic contact tabs are enclosed by a so-called covering spring element (support element), wherein the covering spring element has covering spring arms, abutting the contact tabs and additionally support these.

At the two walls of the covering spring element extending at a right angle to the contact springs, two formations are provided, which hold the contact tabs at a distance in a pre-tensioned manner, as long as no terminal tab is inserted. The formations are produced such, that two parallel cuts are provided in the walls of the covering spring element, so that one strip, connected to the walls of the box-like spring, is achieved, which is deformed in the direction towards the contact tabs.

Of disadvantage in this embodiment is, that by means of the formations it is possible to hold the contact tabs in a pre-tensioned manner, so that with the inserted terminal tab a high contact pressure is achieved, however, in the lateral direction the possibility is given, that the terminal tab vibrates, so that a corresponding wear is produced and because of the vibration also in operation a noise can be produced.

SUMMARY OF THE INVENTION

Therefore, it is an object of the invention, to provide a female terminal, which also ensures, that the contact tabs hold with a high pre-tensioning force during operation a terminal tab between them, so that an advantageous electrical connection is produced, which, however, is, furthermore, suitable to dampen vibrations, occurring during operation on the terminal tab.

This object is solved according to the invention by a female terminal for receiving a flat male terminal with a terminal tab having a rectangular cross-section with a predetermined width and thickness. The female terminal comprises: a contact element (1, 101), forming a longitudinal axis (2, 102), having two elastic contact tabs (3, 103) approaching each other along the longitudinal axis (2, 102), the contact tabs having, respectively, opposing contact zones (4, 104) for contacting in a clamped manner the terminal tab (5) therebetween; a tubular and rectangular support element (16, 116) connected to the contact element, the support element being defined by four walls (19, 20, 21, 22; 119, 120, 121, 122), enclosing the contact element (1, 101) and in which the elastic contact tabs (3, 103) are accommodated; and means (13, 113) for electrically connecting a conductor. A first pair of the walls (19, 21; 119, 121) oppose each other and cover the contact tabs (3, 103) and a second pair of the four walls (20, 22; 120, 122) oppose each other and are substantially perpendicular to the first pair of opposed walls, the second pair of walls having an elastic locking tab (26, 126) connected thereto at an end arranged close to a first end (17, 117) of the support element (16, 116). The elastic locking tabs (26, 126) engage between the elastic contact tabs (3, 103) and hold the contact zones (4, 104) of the contact tabs in a pre-tensioned and contact free manner at a distance (A) from each other, which is smaller than the thickness (D) of the terminal tab (5), in a condition in which the flat male terminal is not inserted. Further, the locking tabs (26, 126) have a free distance (C) therebetween before the insertion of the terminal tab (5), which is smaller than the width (B) of the terminal tab (5) wherein the locking tabs (26, 126) contact the terminal tab (5) in the inserted position along the longitudinal axis (2, 102) in a contact area which is off-set further from the first end (17, 117) of the support element (16, 116) than the contact zones (4, 104) of the contact tabs (3, 103).

Advantageous in this embodiment is, that the terminal tab, which is accommodated in the female terminal, is elastically acted upon by the contact tabs as well as by the locking tabs, so that a secure retainment is achieved. Furthermore, vibrations, produced transversally to the direction of action of the contact tabs are effectively dampened. Such vibrations can cause frictional corrosion or wear, respectively, at the contact zones, whereby the transition resistance is immensely reduced.

According to a further improvement of the first embodiment, the contact element has a hollow rectangular base portion with a first end and a second end and four side walls arranged in pairs opposed to each other. From the first end of the base portion, and from two opposed side walls, respectively, an elastic contact tab projects along the longitudinal axis, which contact tabs approach each other away from the first end and form opposed to each other, respectively a contact zone.

In this embodiment the elastic contact tabs are arranged to the contact element. This is, correspondingly, formed rigid because of the hollow rectangular base portion, wherein additionally the support is achieved via the support element, enclosing the contact element. Because of this design it is also possible, to form the contact element and the support element from different materials. Advantageous is for example, if the support element is made from a rust-resistant steel and therefore, formed, for example, from a metal sheet, so that a box-like shape is achieved, wherein the locking tabs also serve for maintaining predetermined position and that no rotational displacement can take place. The contact element can be made from a material having a good electrical conductivity.

Such a structure is especially important, as the invention concerns very small female terminals, which are, for example, provided for terminal tabs, which cross-section has a width in the range of 1 mm and a thickness in the range of 0.6 mm.

In a further embodiment of the invention it is provided, that the means for electrically connecting a conductor are formed by crimping tabs formed integrally with the second end of the base portion of the contact element.

Additionally, for an insulated conductor, crimping tabs are provided, which serve for the press-clamping connection to the insulation.

A further embodiment provides that the support element serves for the connection to the conductor, while the contact element has only two contact tabs connected to each other and accommodated in the support element. In this case it is provided, that the means for electrically connecting a conductor are formed by crimping tabs formed integrally with the support element.

To facilitate the insertion, in both embodiments, it is provided, that the contact tabs extend again away from each other following the contact zone.

To be able to allow an insertion in a more accurate manner, it is provided, that the contact tabs terminate in front of an insertion opening of the support element and that the support element form by means of wall portions of the two walls covering the contact tabs, which wall portions are inverted towards the inside and towards the free ends of the contact tabs, guiding faces for a terminal tab to be inserted. Thus, it is prevented, that the terminal tab can accidentally get under the contact tabs.

Two preferred embodiments of the invention are schematically represented in the drawings.

DETAILED DESCRIPTION OF THE INVENTION

In the following description of the two embodiments of a female terminal according to the invention, the term contact element 1, 101 is intended to refer to the element that includes contact tabs 3, 103. The support element 16, 116 refers to the element which accommodates the contact element 1, 101. The crimping tabs can, therefore, be arranged as part of the contact element, as it is provided in the embodiment of FIGS. 1 to 6, or as part of the support element, as it is provided in the embodiment of FIG. 7.

Figure 8:
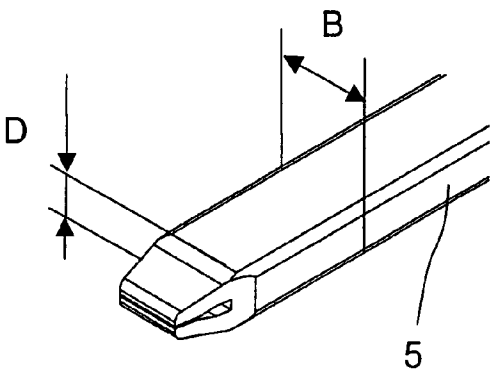
FIG. 8 is a perspective view of a portion of a terminal tab of a flat male terminal.

Both embodiments of the female terminal serve to be connected to a flat male terminal, having a terminal tab 5, as represented in FIG. 8, and having a width B and a thickness D. The width B is, for example, 1.2 mm, while the thickness D is 0.63 mm.

A plurality of the female terminals according to the invention are accommodated in a housing of a coupling (connector) and are connected to a further coupling element (mating connector), having a corresponding number of terminal tabs.

The following is a description of the first embodiment of the invention with reference to FIGS. 1 to 6.

The female terminal according to this embodiment comprises a contact element 1, forming the longitudinal axis 2, which also represents the longitudinal axis of the whole female terminal. The contact element 1 comprises a base portion 6, having a first end 7 and a second end 8 and formed box-like in cross-section, i.e. forming a rectangular hollow profile, having the side walls 9, 10, 11, 12. The two side walls 9 and 12 form a pair and are arranged opposed to each other. The two side walls 10, 11 form also a pair and are arranged opposed to each other but are arranged perpendicular to the two other sidewalls 9, 12. Contact tabs 3, which with increasing distance from the first end 7 approach each other and form before their free ends contact zones 4 facing each other, project from the first end 7 of the two opposed side walls 9, 12. Starting from the contact zones 4 and continuing in a direction away from the first end 7, the contact tabs 3 diverge from each other, so that a type of insertion funnel is formed. The contact element 1 has concerning its base portion 6 a second end 8, representing an edge extending at a right angle to the longitudinal axis 2. A transition portion 15 is connected to the base portion 6 and extends away from the first end 7 and second end 8, ending in first crimping tabs 13 for connecting a conductor. Distanced thereto, two second crimping tabs 14 for the insulation of the cable are provided, having the conductor.

The contact element 1 is integrally stamped out or formed from a sheet of metal. In the above described embodiment it is, preferably, made from a material, having an advantageous electrical conductivity.

The base portion 6 and the contact tabs 3 projecting therefrom, are enclosed by a hollow profile, having a rectangular cross-section and which forms the support element 16. The support element 16 has a first end 17 and a second end 18. It further comprises the walls 19, 20, 21, 22, wherein the walls 19 and 21 are arranged opposed to each other and cover the contact tabs 3. In the two walls 20, 22, arranged at a right angle thereto, first openings are provided, which are not represented in detail, and into which the contact element projects with projections on the side walls 10, 11. The support element 16 has, further, in the area of the walls 20, 22, through holes, into which retaining projections 24, projecting from the side walls 10, 11 of the contact element engage, so that the contact element 1 and the support element 16 are securely connected to each other.

Figure 1:
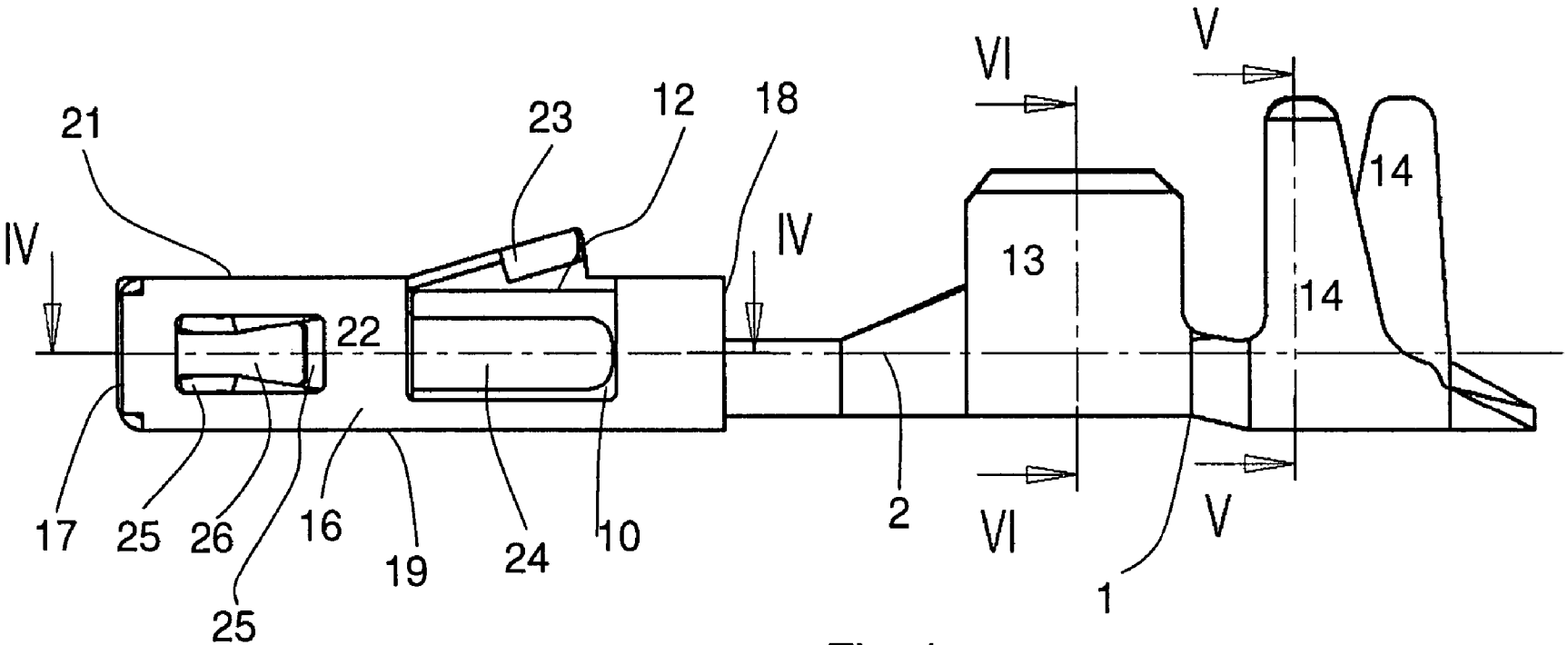
FIG. 1 is a side view of a first embodiment of a female terminal according to the invention.
Figure 2:
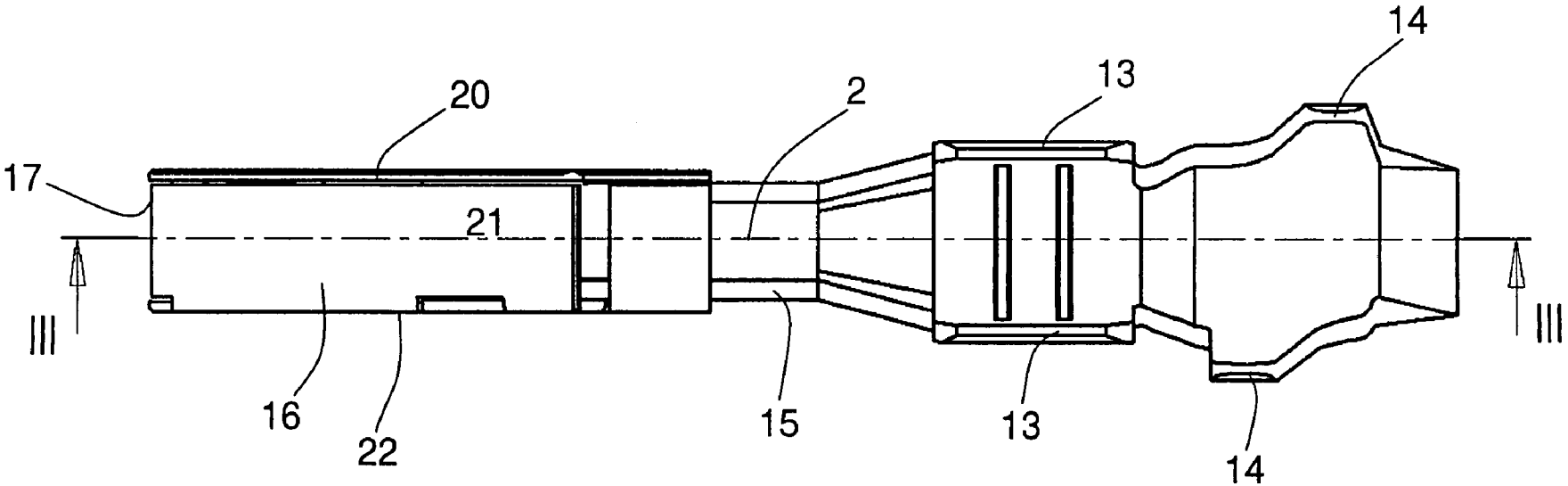
FIG. 2 is a top view onto the female terminal of FIG. 1 according to the first embodiment.
Figure 3:
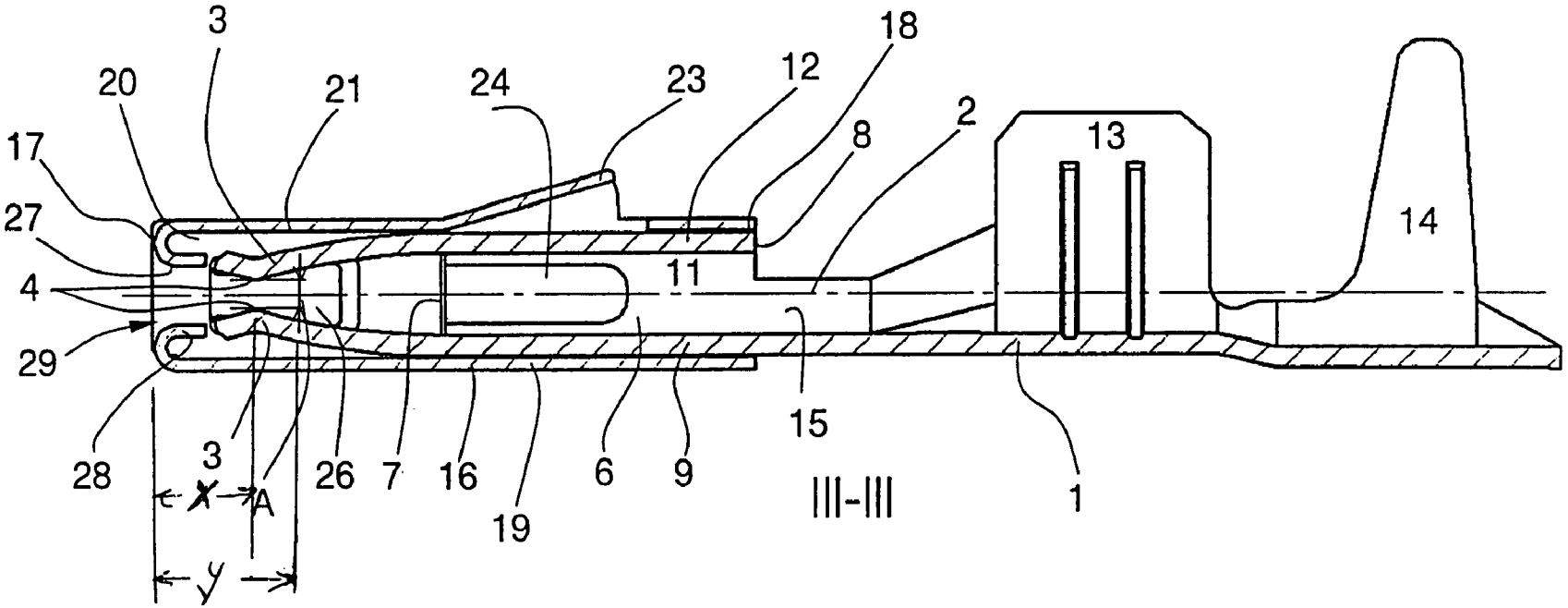
FIG. 3 is a longitudinal sectional view III—III of FIG. 2.
Figure 6:
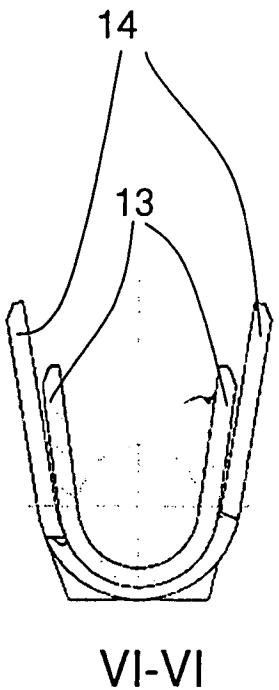
FIG. 6 is a sectional view along line VI—VI of FIG. 1.
Figure 5:
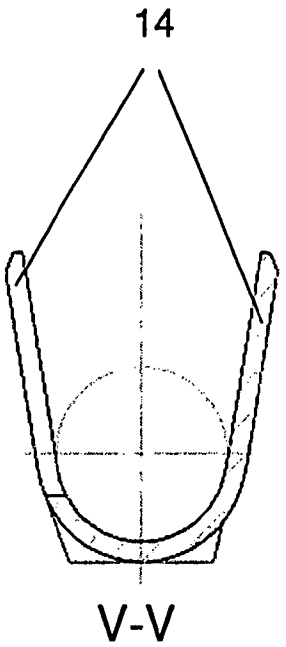
FIG. 5 is a sectional view along line V—V of FIG. 1.
Figure 4:
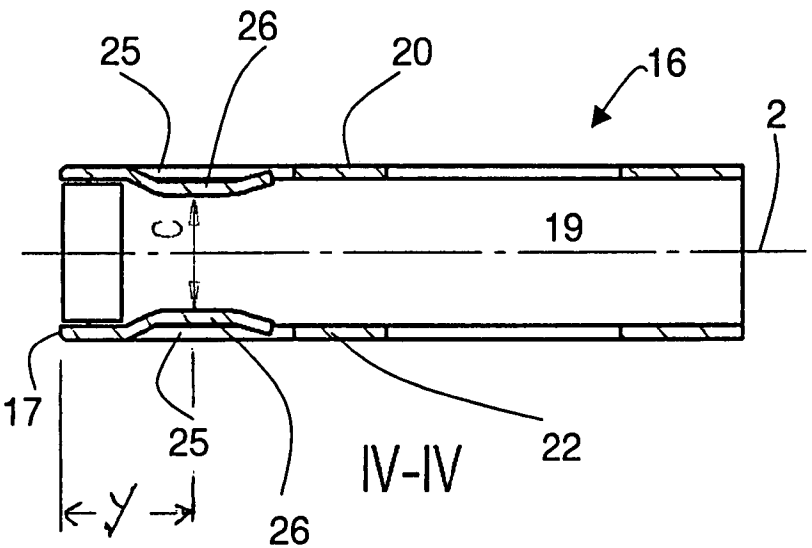
FIG. 4 is a sectional view along line IV—IV of FIG. 1, wherein, however, only the support element is shown.

A retaining tab 23 projects from the wall 21. This retaining tab 23 serves, for example, to retain the female terminal in a housing (not shown) of a coupling element (connector). In both walls 20, 22 openings 25 are provided, exposing by means of punching locking tabs 26, wherein the locking tabs 26 with their end, arranged close to the first end 17, are connected to a corresponding one of the walls 20, 22 and extend otherwise inwards (towards the longitudinal axis 2) in direction towards the contact tabs 3, arranged transversally thereto, so that they engage between the same and retain these in a pre-tensioned manner at a distance A of their contact zones 4, wherein this distance A is slightly smaller than the thickness D of the terminal tab 5 of FIG. 8. The locking tabs 26 approach each other with their free ends in the opening 25 and form contact areas, with which they contact the side edges of the terminal tab 5, wherein the distance C, visible in FIG. 4 is, as long as no terminal tab 5 is inserted, smaller than the width B of the terminal tab 5 of FIG. 8. The contact area of the locking tabs 26, with which these contact (in the inserted condition) the side faces of the terminal tab 5, is arranged along the longitudinal axis 2 further away from the first end 17 of the support element 16 (i.e., a distance y in FIGS. 3 and 4) than the contact zones 4 of the contact tabs 3 of the terminal 1 are arranged from this first end 17 (i.e., a distance x). Thus, it is achieved, that, when inserting a terminal tab 5 of FIG. 8, this together with its wider sides, i.e. with its upper side and its lower side, contacts the contact tabs 3 in the area of their contact zones 4 and pushes the contact tabs 3 further apart and meets only later the elastic locking tabs 26 and pushes these apart, whereby the terminal tab is acted upon, in the completely inserted condition, by the contact tabs 3 as well as the locking tabs 26 and is, therefore, held securely.

Starting from its front first end 17, the support element 16 has on the two opposed walls 19, 21 wall portions 27, 28, bent inwards and extending close to the free ends of the contact tabs 3 and thus, form an insertion opening 29, which ensures, that, when inserting a terminal tab, the same cannot abut head-on the contact tabs 3.

The support element 26 is, preferably, made from a rust-resistant steel and also starting from a sheet by means of punching and bending. Hereby, the seams can also be welded to each other, which is also applicable to the contact element 1 in the area of the base portion 6, where also the walls could be connected to each other by means of welding points or welding seams.

Figure 7:
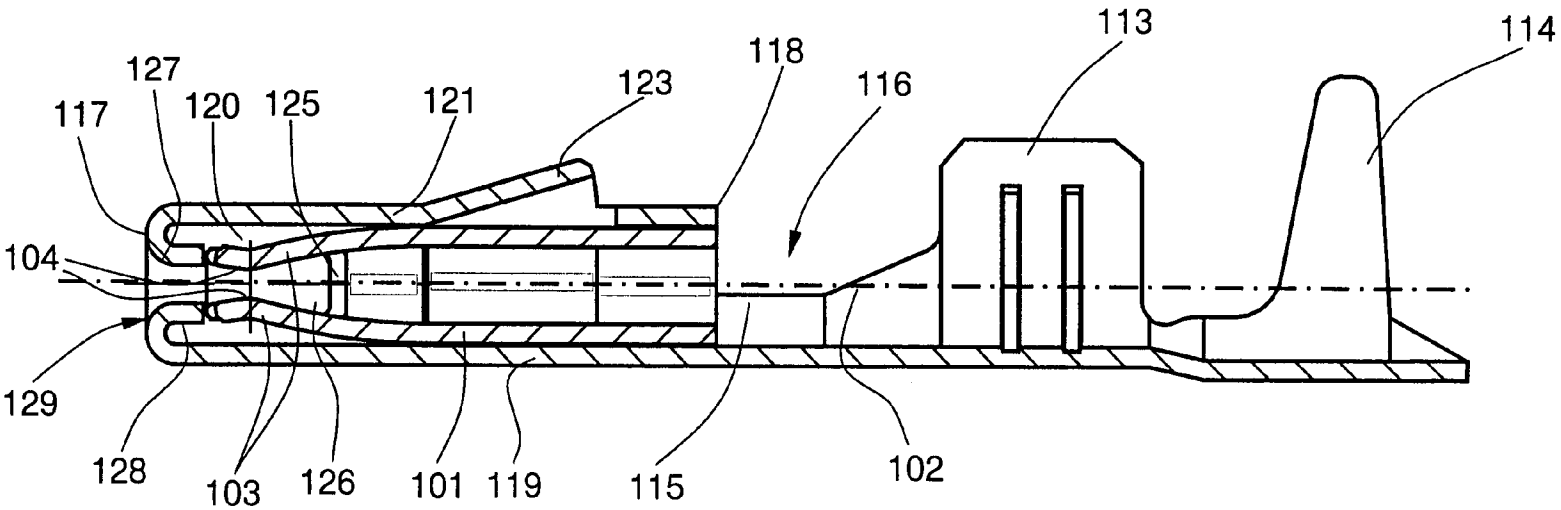
FIG. 7 is a sectional view of a further embodiment of a female terminal.

In the second embodiment shown in FIG. 7 the contact element 101 is reduced to the contact tabs 103, connected to each other, with the contact zones 104. These are accommodated in a support element 116, holding the contact element 101. The essential difference to the embodiment of FIGS. 1 to 6 is, that the crimping tabs 113 and 114 are not connected to the contact element 101, but are connected to the support element 116, i.e. are formed integrally with this. In the following the description for the embodiment of FIGS. 1 to 6 is valid analogically for the embodiment of FIG. 7, wherein, however, in the embodiment of FIG. 7 reference numerals are used, which, compared to those of the embodiment of FIGS. 1 to 6, are increased by the numerical value 100. Concerning their description it is referred to the description of FIGS. 1 to 6.

What is claimed is:

1. A female terminal for receiving a flat male terminal with a terminal tab (5), having a rectangular cross-section and a predetermined width (B) and thickness (D), comprising:

a contact element (1, 101), forming a longitudinal axis (2, 102), having two elastic contact tabs (3, 103) approaching each other along the longitudinal axis (2, 102), said contact tabs having, respectively, opposing contact zones (4, 104) for contacting in a clamped manner the terminal tab (5) therebetween;

a tubular and rectangular support element (16, 116) connected to the contact element, said support element being defined by four walls (19, 20, 21, 22; 119, 120, 121, 122), enclosing the contact element (1, 101) and in which the elastic contact tabs (3, 103) are accommodated; and means (13, 113) for electrically connecting a conductor, wherein a first pair of the walls (19, 21; 119, 121) oppose each other and cover the contact tabs (3, 103) and a second pair of the four walls (20, 22; 120, 122) oppose each other and are substantially perpendicular to the first pair of opposed walls, said second pair of walls having an elastic locking tab (26, 126) connected thereto at an end arranged close to a first end (17, 117) of the support element (16, 116), wherein the elastic locking tabs (26, 126) engage between the elastic contact tabs (3, 103) and hold the contact zones (4, 104) of the contact tabs in a pre-tensioned and contact free manner at a distance (A) from each other, which is smaller than the thickness (D) of the terminal tab (5), in a condition in which the flat male terminal is not inserted, wherein the locking tabs (26, 126) have a free distance (C) therebetween before the insertion of the terminal tab (5), which is smaller than the width (B) of the terminal tab (5) and wherein the locking tabs (26, 126) contact the terminal tab (5) in the inserted position along the longitudinal axis (2, 102) in a contact area which is off-set further from the first end (17, 117) of the support element (16, 116) than the contact zones (4, 104) of the contact tabs (3, 103).

2. The female terminal according to claim 1, wherein the contact element (1) has a hollow rectangular base portion (6) with a first end (7) and a second end (8) and four side walls (9, 10, 11, 12) arranged in pairs opposed to each other, at which from the first end (7) of the base portion (6), and from two opposed side walls (9, 12), respectively, the elastic contact tab (3) projects along the longitudinal axis (2), wherein the contact tabs (3) approach each other away from the first end (7) and form opposed to each other, respectively a contact zone (4).

3. The female terminal according to claim 2, wherein the means for electrically connecting a conductor are formed by crimping tabs (13, 14) formed integrally with the second end (8) of the base portion (6) of the contact element (1).

4. The female terminal according to claim 1, wherein the means for electrically connecting a conductor are formed by crimping tabs (113) formed integrally with the support element (116).

5. The female terminal according to claim 1, wherein the contact tabs (3, 103) following the contact zone (4, 104) extend again away from each other.

6. The female terminal according to claim 1, wherein the contact tabs (3, 103) terminate in front of an insertion opening (29, 129) of the support element (16, 116) and wherein the support element (16, 116) forms guiding faces for a terminal tab (5) to be inserted, said guiding faces being formed by wall portions (27, 28; 127, 128) of the first pair of walls (19, 21; 119, 121), which wall positions are inverted towards the inside and towards the free ends of the contact tabs (3, 103).

7. The female terminal according to claim 5, wherein the contact tabs (3, 103) terminate in front of an insertion opening (29, 129) of the support element (16, 116) and that the support element (16, 116) forms guiding faces for a terminal tab (5) to be inserted, said guiding faces being formed by of wall portions (27, 28; 127, 128) of the first pair of walls (19, 21; 119, 121) , which wall positions are inverted towards the inside and towards the free ends of the contact tabs (3, 103).

* * * * *